United States Patent [19]

Hasenwinkle et al.

[11] Patent Number: 4,834,585

[45] Date of Patent: May 30, 1989

[54] LANDSCAPE TIMBER BUILDING MODULE

[75] Inventors: Earl D. Hasenwinkle, Puyallup; Frank Wislocker, Sumner, both of Wash.

[73] Assignee: Weyerhaeuser Company, Tacoma, Wash.

[21] Appl. No.: 115,017

[22] Filed: Oct. 29, 1987

[51] Int. Cl.[4] ..... E02D 29/02

[52] U.S. Cl. ..... 405/286; 52/233; 405/284; 446/122

[58] Field of Search ..... 405/284, 285, 286, 287; 446/122, 123, 106, 107, 128; 52/236.1, 233

[56] References Cited

U.S. PATENT DOCUMENTS

| | | | |
|---|---|---|---|
| 2,365,397 | 12/1944 | Dickman | 52/233 X |
| 2,687,033 | 8/1954 | Snyder . | |
| 3,006,038 | 10/1961 | Sullivan | 405/284 X |
| 3,324,619 | 6/1967 | Gearhart | 446/128 X |
| 3,487,579 | 1/1970 | Brettingen | 446/128 |
| 3,742,665 | 7/1973 | Henry et al. | 52/284 |
| 4,040,630 | 8/1977 | Brattain | 446/128 X |
| 4,312,606 | 1/1982 | Sarikelle | 405/286 |
| 4,391,077 | 7/1983 | Giess | 52/747 |
| 4,463,532 | 7/1984 | Faw | 52/233 |
| 4,522,006 | 6/1985 | Plikuhn | 52/233 X |

FOREIGN PATENT DOCUMENTS

| | | |
|---|---|---|
| 2615891 | 10/1977 | Fed. Rep. of Germany . |
| 2836701 | 2/1980 | Fed. Rep. of Germany . |
| 426535 | 5/1935 | United Kingdom . |

*Primary Examiner*—Dennis L. Taylor

[57] ABSTRACT

A landscape timber building module is constructed preferably from a solid piece of wood with a predetermined length and width. At least two flat opposed, substantially parallel surfaces, have a plurality of uniformly spaced holes extending therethrough. Each end of the module is curved with a radius extending from approximately the centerline of the second hole inwardly from the end. The individual modules are then used, preferably after being treated with a preservative compound, as building elements to form composite landscaping structures. Individual modules are interconnected by the use of pin connectors inserted through aligned holes in the modules.

6 Claims, 2 Drawing Sheets

FIG. 4
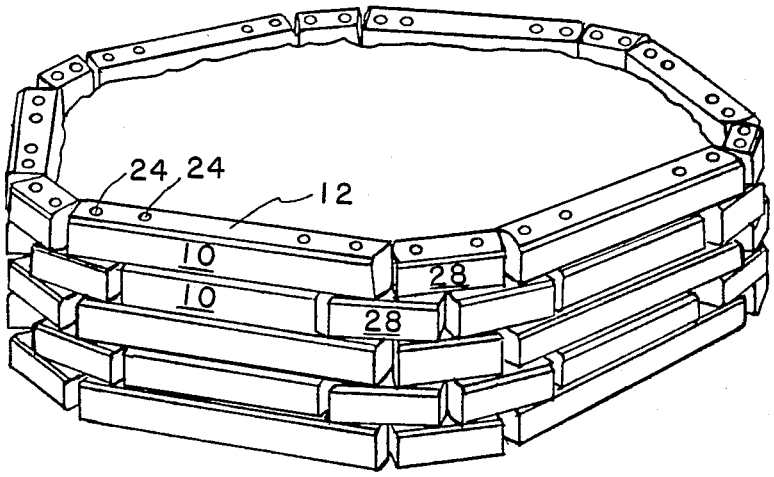
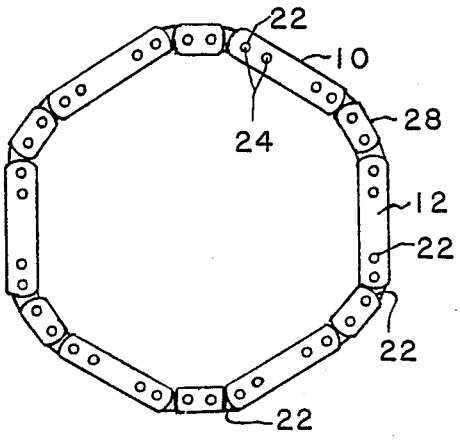
FIG. 5
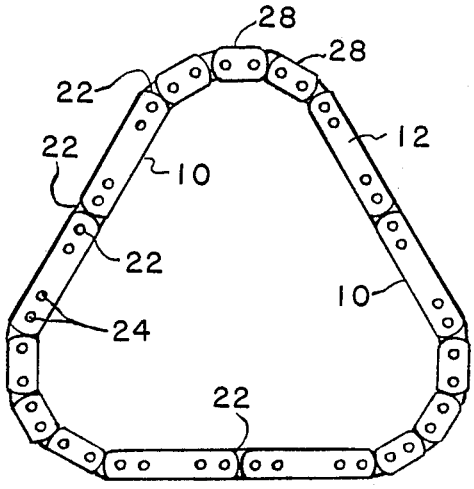
FIG. 6

LANDSCAPE TIMBER BUILDING MODULE

BACKGROUND OF THE INVENTION

This invention relates generally to aesthetically pleasing structural building elements for use in landscaping applications. More particularly, it relates to an improved form of landscape timber; one that is in a preselected modular form suitable for selection and use in building a wide variety of composite landscaping structures.

In the past landscape timbers have taken several different forms. One common form is the traditional treated railroad tie which is in an elongated rectangular cross sectional shape. They are normally treated with creosote for preservation purposes. When the typical home do-it-yourselfer elects to use the railroad tie as a landscape timber it will be purchased in the large heavy form and the homeowner/user must then decide how best to utilize the timbers. When smaller pieces are needed, the large railroad ties must be cut and the cutting operation is difficult for the average do-it-yourselfer. Not only is the timber heavy and difficult to handle but the creosote is dirty and soils clothes and the like. While the use of treated railroad ties serves the purpose for landscaping applications, composite structures will have relatively large flat surfaces without the appearance of more pleasing relatively smaller and rounded surfaces. In addition, when tying a plurality of the railroad ties together to form a preselected composite structure, the do-it-yourselfer will have to drill and then tie the pieces together with large spikes or nails. Sometimes long bolts and nut systems are used for joinder purposes. The common methods of joining the large rectangular pieces together are time consuming and difficult.

Another form of landscape timber is that usually produced from "peeler cores." A peeler core is the elongated circular wood piece left after a rotary veneer lathe has produced a ribbon of veneer from a larger "peeler block." Quite typically with today's machinery the peeler cores are in a diameter range around 4.0 inches. It is common to predetermine the peeler core diameter for purposes of end use applications of the cores, one such being conversion of the cores into landscape timbers. While circular members could be used for landscape timber applications, it is more common to machine two opposed flat surfaces into the wooden member to form a more versatile type of landscape timber construction element. While this form of landscape timber will usually be treated for perservation purposes, they will normally be treated with other treating compounds such as CCA rather than creosote. While these landscape timbers are not as dirty nor are they as heavy as treated railroad ties, they are still relatively heavy and difficult to fabricate into composite structures. They are typically sold as solid pieces although some distributors will provide a cut-to-length service for their customers provided the customer/do-it-yourselfer knows what to specify. One advantage to this form of landscape timber is its more pleasing appearance with rounded surfaces.

It has therefore been recognized that an improved form of landscape timber would be desirable for use and application by both do-it-yourselfers and professional landscapers. A landscape timber that is both aesthetically pleasing in appearance, easy to work with, and which is flexible in that multiple structural shapes are feasible are features embodied in the present invention.

The concept of the present invention involves the discovery that by cutting and predrilling machined peeler cores or the like into shorter modules and also rounding the ends they can, as individual presized modules, then be pinned or otherwise connected into a variety of patterns including curved edges, retaining walls, and other landscaping composite structures. In presized and predrilled modules the pieces become much easier for the average do-it-yourselfer to handle and fabricate into composite structures of choice. In other words the user has more freedom of design choice and once the design is selected an easier time when building it. After completion, the structure will be one having a very pleasing appearance in the context of the landscape where it resides.

SUMMARY OF THE INVENTION

Briefly stated this invention is practiced in one form by machining a substantially circular elongated peeler core or the like into a modularized presized landscape timber element. The module can have two opposed flat surfaces and two opposed curvilinear surfaces with the distance between the two curvilinear surfaces through the centerlines being, for example, approximately 4.0± inches. A plurality of holes are drilled through the opposed flat surfaces normal thereto with the centerline of one hole spaced a predetermined distance inwardly from either end. Additional holes may be uniformly spaced therefrom each having the same characteristics. Each end of the module is rounded with a predetermined radius with the radii extending to the centerline of the two holes spaced inwardly from the ends. One basic module length was found to be 24.00± inches with six holes therethrough spaced accordingly. Other module lengths such as 8.0 and 16.0± inches are also very functional and useful in building landscaping structures.

BRIEF DESCRIPTION OF THE DRAWINGS

FIG. 4 is an isometric view similar to FIG. 3 showing an entire circular structure incorporating modules of different lengths.

FIG. 5 is a top plan view of the structure shown in FIG. 4 illustrating the angularity between adjacent modules.

FIG. 6 is also a top plan view of another typical structure that can be constructed using selected modules.

DESCRIPTION OF THE PREFERRED EMBODIMENT

Figure 1:
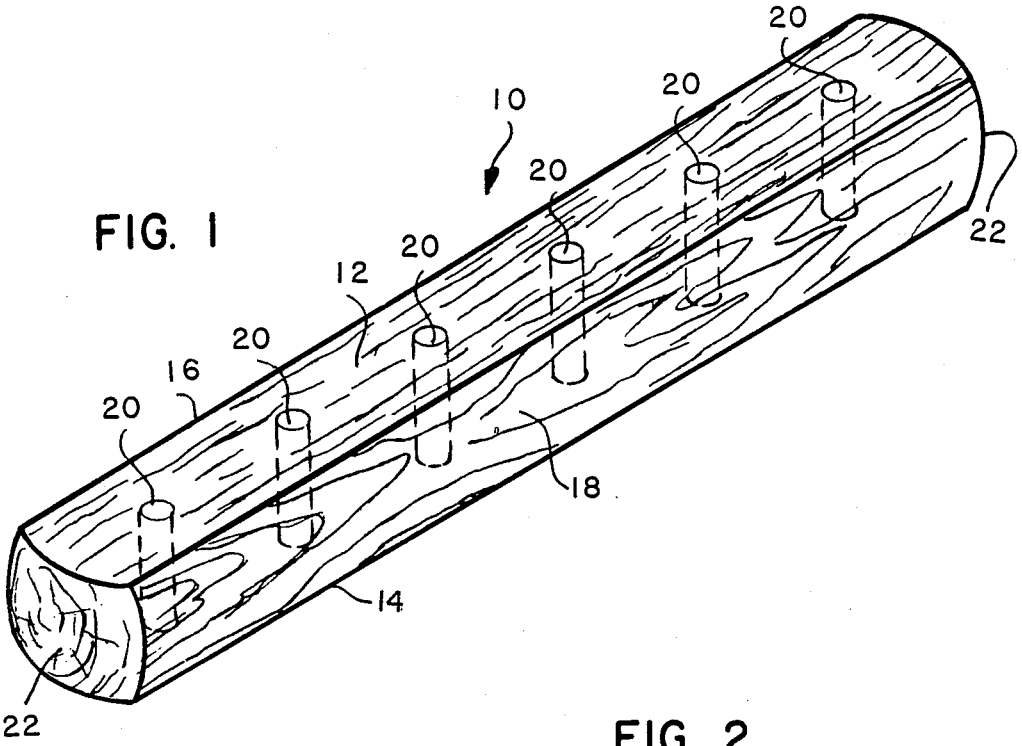
FIG. 1 is an isometric view showing a six hole module.

Referring first to FIG. 1 the characteristics of the landscape timber module of the present invention will be disclosed. The basic module is indicated at 10. While the module could be fabricated from material other than wood the preferred embodiment is solid wood with the starting raw material a circular elongated wood member. In the manufacture of veneer from rotary lathes a peeler core is discharged from the lathe which is an elongated solid wood member with a diameter of about 4.0± inches. This is an ideal starting raw material for production of the present invention. Usually peeler cores are eight feet long and as noted in the background have been used to produce very long, hard to handle, landscape timbers. A feature of this invention is to cut the elongated peeler cores, if they are the starting raw material, into smaller segments.

The finished landscape timber module 10 illustrated in FIG. 1 has a length of about 24.00 inches. There are two flat opposed surfaces 12, 14 which are machined from the circular raw material. Any suitable wood machining means can be utilized to establish surfaces 12, 14, such as rotary cutting tools or saw blades. The flats are established so they are substantially parallel to one another and have a width of about 3.0 inches. After the flats are produced, two opposed curvilinear surfaces 16, 18 will be formed and the distance therebetween will, of course, be the diameter dimension of the starting raw material. This dimension could be 4.00± inches which is a common peeler core size for veneer lathes producing veneer in the southern states of the U.S.A. Other modular lengths suitable for a base modular length of 24 inches are 8, 16 and 48 inches.

Figure 2:
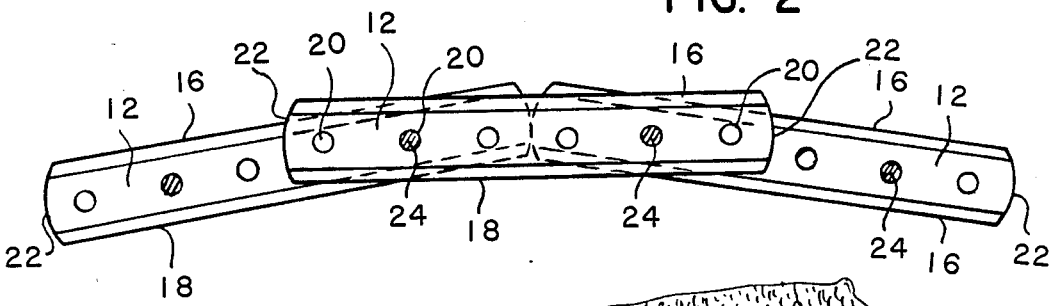
FIG. 2 is a top plan view showing three modules interconnected in a typical manner to illustrate forming a curved structure.

Uniformly spaced in module 10 is a plurality of connector holes each indicated as 20. The holes 20 are drilled or otherwise established so they are normal to flat surfaces 12, 14 and located approximately along the centerline of module 10. Holes 20 extend through module 10. One hole spaced inwardly from each end of module 10 is located at a predetermined location with respect to the adjacent near end of module 10, each end being indicated at 22. The location is selected based on the dimension between surfaces 16, 18 and the fact that in the preferred embodiment ends 22 are rounded with a radius from the centerline of the hole located accordingly so that when two adjacent modules are interconnected as illustrated in FIG. 2, they are allowed to be positioned angularaly with respect to one another without an excessive gap therebetween. In the embodiment depicted in FIG. 2 the radius is 6.0 inches which is from the holes that are located one-fourth of the total length inward from the ends. The number of holes can vary but generally is a function of the length which is also an approximate function of the width of the module.

With the two connector holes 20 properly located inwardly from each end of module 10 the additional holes are spaced uniformly therefrom. The reason for having additional uniformly spaced holes 20 is to afford flexibility in interconnecting a plurality of modules 10 into a composite building structure such as that illustrated in FIGS. 3–6.

In FIG. 2 the holes 22 that are cross hatched illustrate that pin connectors 24 are inserted therein and function to interconnect the three modules with the planar shape as shown. Pin connectors 24 are suitably sized (diameter and length) to extend through the requisite number of aligned holes in overlying modules when constructed to form a composite building structure such as those illustrated in FIGS. 3–6. Rigid hollow pipe sections or shaped extruded sections made from durable, corrosion resistant material are cut accordingly and can be provided in uniform sizes depending upon the height of the composite structure to be constructed. The length is sized to allow enough of the pin connector to extend into the ground for sufficient anchoring strength. In determining the size for holes 22 they will be sized to accept the cross sectional size and shape of pin connectors 24.

Since the preferred material for the modules is solid wood and because the module of the present invention is primarily used as a landscape timber building element, it is highly desirable to treat the finally sized, cut and drilled module with a preservative compound such as CCA (chromated copper arsenate). There are a number of treating companies in the business of injecting such compounds, usually in a pressure treating process, into wood. Therefore, in a manufacturing process for producing landscape timber modules 10 the raw material will be processed, preferably in an automated manner, to create the machined surfaces, rounded corners and holes, and thereafter they will be treated prior to distribution.

Figure 3:
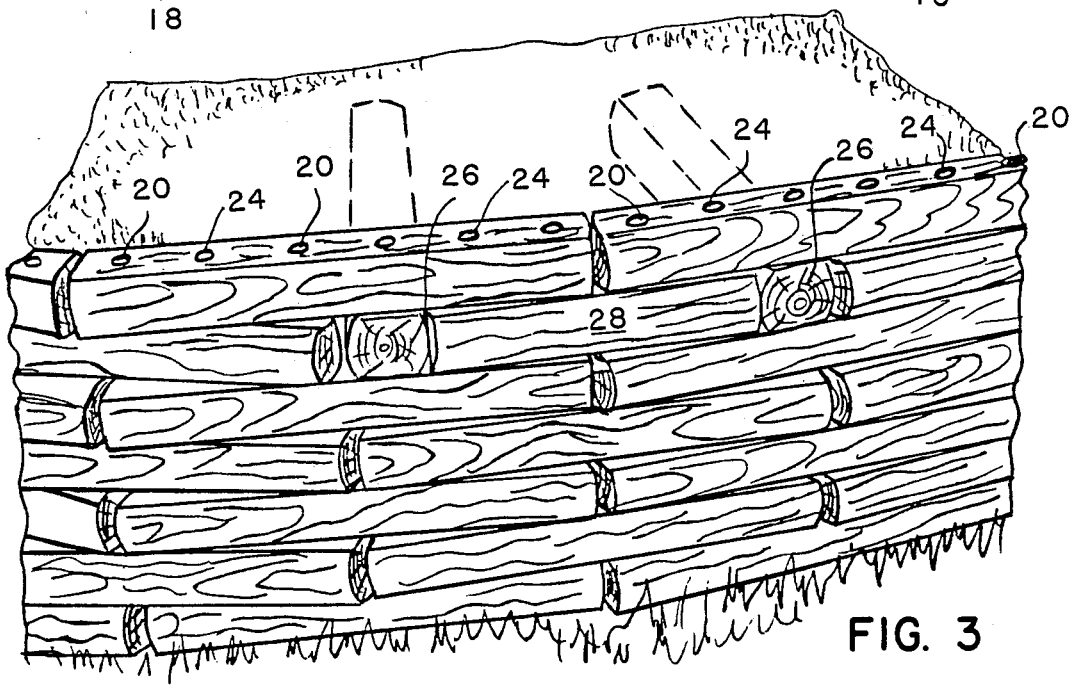
FIG. 3 is an isometric view showing a plurality of modules interconnected into a curved wall structure including the use of modules as back stays.

In utilizing individual modules a do-it-yourselfer or professional landscaper should first prepare the structural design for the structure to be built which will be based on the dimensions of the available modules and the size, shape and structural requirements of the final composite structure. In FIG. 3 a section of a vertically extending curved retaining wall is shown which includes seven rows of laterally offset modules 10. Elongated modules 10 are utilized in this composite structure as back stay members indicated at 26. To account for the gap necessary between the adjacent modules in the row where the back stays 26 are inserted there is a relatively shorter module indicated at 28 which is similar to other modules except for its length which is a multiple of the standard modular length. Instead of having the standard length with six holes module 28 is a shorter multiple with four holes. In FIGS. 4–6 even shorter modules are illustrated but each module still has the two flat surfaces, rounded ends, and at least two connector holes.

In building the curved retaining wall of FIG. 3 the correctly sized modules are first acquired and the first row laid firmly in place. Pin connectors that are long enough to extend upwardly for the height of seven rows plus a dimension for extending into the ground are threaded through the second holes at either end of the modules and pushed downwardly a small amount into the ground. In addition, to firmly fix the back stays 26 in place another pin connector is threaded through the hole in the lowest module that will be in line with and underlie the outermost hole in the module forming the back stay. The second row of modules is then threaded over the upstanding pin connectors with adjacent modules in the second row being offset one-half pitch from those in the first row. As the modules are moved into place, the curved effect will be obtained by properly laying out the locations for the pin connectors and by utilizing the second holes in from each end as the interconnecting holes for the relatively longer modules. Each row is completed by alternately offsetting the pitch by one-half and in the row where the ends of the back stay modules are located they will be positioned atop the lower module to extend backwardly into some supporting means with the hole aligned over a hole in the lower module. The last row in the wall shown in FIG. 3 is laid in the same manner with the modules being threaded over the tops of the upstanding pin connectors. After the top row is in place the remaining upstanding portions on all the pin connectors can be pounded downwardly further into the ground so as to further anchor the structure and to make for an aesthetically pleasing completed appearance.

In FIGS. 4–6 the short modules have only a pair of connector holes and in the embodiment depicted the radius for the rounded ends will be less than that of the longer modules. This feature will be well understood by those skilled in the art of wood construction and landscape design.

It will be appreciated that a very versatile, easy to handle, building module has been described as has a way to make and use them in composite landscaping structures. Many shapes can be created by the do-it-yourselfer and when constructing the designed structure, it will be fabricated in a relatively easy expeditious manner.

While a detailed dislcosure is provided herein of the preferred embodiment, changes and modifications may occur to those skilled in the art. All such changes and modifications are intended to be included within the following claims.

We claim:

1. A landscape timber building module for use use in constructing landscaping structures which include a plurality of the modules with at least two of the modules in a landscaping structure being in substantial abuttment with one another at two opposed ends comprising:

a wood based elongated member of a predetermined length having at least two substantially parallel flat opposed surfaces forming the upper and lower surfaces of the module and each end of the member being rounded so the at least two abutting modules in a landscaping structure can be pivoted relative to each other and a plurality of holes in the module extending through the flat surfaces substantially normal thereto and spaced a predetermined distance from the rounded ends.

2. The module as in claim 1 in which the length is a predetermined multiple of eight inches.

3. The module as in claim 2 in which the eight inch module has a pair of holes and rounded ends with radii less than longer modules.

4. The module as in claim 1 in which the radii for the rounded ends is about six inches extending outwardly from a location in proximity to the inwardly spaced holes.

5. The module as in claim 1 in which the plurality of holes are uniformly spaced and substantially inline.

6. The module as in claim 1 in which the holes are sized to accept a pin connector inserted therein.

* * * * *